US008755529B2

(12) United States Patent
Huang et al.

(10) Patent No.: US 8,755,529 B2
(45) Date of Patent: Jun. 17, 2014

(54) METHOD AND DEVICE FOR ESTABLISHING NETWORK CONNECTION

(75) Inventors: Liang-Wei Huang, Hsinchu (TW); Cheng-Han Lee, Taipei County (TW); Yi-Huei Lei, Taipei (TW); Kai-Wen Cheng, Hsinchu County (TW)

(73) Assignee: Realtek Semiconductor Corp., Hsinchu (TW)

( * ) Notice: Subject to any disclaimer, the term of this patent is extended or adjusted under 35 U.S.C. 154(b) by 77 days.

(21) Appl. No.: 13/336,697

(22) Filed: Dec. 23, 2011

(65) Prior Publication Data

US 2012/0163604 A1 Jun. 28, 2012

(30) Foreign Application Priority Data

Dec. 28, 2010 (TW) ..... 99146245 A

(51) Int. Cl.
*H04K 1/00* (2006.01)

(52) U.S. Cl.
USPC ..... 380/287; 380/28; 380/268

(58) Field of Classification Search
None
See application file for complete search history.

(56) References Cited

U.S. PATENT DOCUMENTS

| | | | | |
|---|---|---|---|---|
| 2005/0286643 | A1* | 12/2005 | Ozawa et al. | 375/242 |
| 2008/0104434 | A1* | 5/2008 | May | 713/322 |
| 2010/0113088 | A1* | 5/2010 | Erceg et al. | 455/552.1 |
| 2010/0226366 | A1* | 9/2010 | Lee et al. | 370/389 |
| 2012/0011217 | A1 | 1/2012 | Weng et al. | |

* cited by examiner

*Primary Examiner* — Shewaye Gelagay
(74) *Attorney, Agent, or Firm* — Birch, Stewart, Kolasch & Birch, LLP

(57) ABSTRACT

A device for establishing network connection is disclosed, having a transmitting circuit, a receiving circuit, and a controller. The transmitting circuit, comprising a first scrambler having a plurality of first registers, transmits a first data scrambled by the first scrambler to a transmission line according to an oscillating signal generated by an oscillation circuit. The receiving circuit receives a second data scrambled by a second scrambler from the transmission line and comprises a descrambler having a plurality of second registers for descrambling the second data. The first and the second scramblers use the same scrambler generator polynomial. The controller compares at least one of the first data and the value of the first registers and at least one of the second data and the values of the second registers for configuring the oscillation circuit to adjust the frequency of the oscillating signal.

14 Claims, 3 Drawing Sheets

METHOD AND DEVICE FOR ESTABLISHING NETWORK CONNECTION

CROSS-REFERENCE TO RELATED APPLICATIONS

This application claims the benefit of priority to Taiwanese Patent Application No. 099146245, filed on Dec. 28, 2010; the entirety of which is incorporated herein by reference for all purposes.

BACKGROUND

The present disclosure generally relates to communication devices and methods and, more particularly, to the full duplex communication devices and methods which may rapidly establish the network connection.

In the process of developing new industrial standards or new applications, existing technologies are often incorporated to shorten the time for research and improve the system stability. The existing technologies, however, may need to be modified to fit in the new standards or new applications.

For example, in the High-Definition Multimedia Interface (HDMI), the fast Ethernet technology, i.e., 100 BASE-TX of the IEEE 802.3u standard, is used in the HDMI Ethernet Channel (HEC) communication. Although both the 100 BASE-TX transceivers and the HEC transceivers may operate in the full duplex mode, the 100 BASE-TX transceiver transmits signals on one twisted pair of conductors and receives signals on another twisted pair of conductors. On the other hand, the HEC transceiver may transmit and receive signals on the same twisted pair of conductors simultaneously. When the near-end HEC transceiver receives the signals transmitted from the far-end HEC transceiver, the near-end HEC transceiver therefore may also receive the signals transmitted by itself. When the near-end HEC transceiver and the far-end HEC transceiver transmit the same signals, both HEC transceivers may not differentiate the near-end signals and the far-end signals and therefore fail to function correctly.

Besides, in the idle mode or in the connection establishment process, the HEC transceivers on both ends need to transmit idle signals. The HEC transceivers continuously and repeatedly transmit the pseudo random code of several thousand bits as the idle signals. The HDMI standard does not adopt the master-slave mechanism and does not require the near-end and the far-end HEC transceivers to use different scramblers. Thus, in the idle mode or in the connection establishment process, the near-end and the far-end HEC transceivers may transmit the same idle signals and therefore fail to function correctly.

Moreover, although the HEC transceivers shall transmit the signals with a 125 MHz frequency, there still may be a difference existed between the transmission frequencies of the transceivers on both ends. For example, a difference with ±200 ppm of the transmission frequency is tolerable in some technical standards. Therefore, even if the near-end and the far-end HEC transceivers are configured to transmit the idle signals from different positions of the same pseudo random code, the difference between the transmission frequencies may still cause the near-end and the far-end HEC transceivers to transmit the same idle signals after a period of time. The HEC transceivers may still fail to function correctly in this configuration.

Furthermore, the transceivers need to establish the network connection more rapidly so as to support the advanced features, e.g., the Energy Efficient Ethernet (EEE) standard defined by IEEE 802.3 az task force. The HEC transceivers need to rapidly establish the network connection before entering the quiet mode (defined in the EEE standard) so that the HEC transceivers may obtain a better signal-to-noise ratio (SNR) and therefore maintain the network connection after leaving the quiet mode.

SUMMARY

In view of the foregoing, it can be appreciated that a substantial need exists for methods and apparatuses that can mitigate or reduce the problems in the communication process.

An example embodiment of a communication device, comprising: a transmitter, comprising a first scrambler with a plurality of first registers, for transmitting to a transmission line a first data scrambled by the first scrambler according to an oscillating signal generated by an oscillation circuit; a receiver, for receiving from the transmission line a second data scrambled by a second scrambler, comprising a descrambler with a plurality of second registers for descrambling the second data; and a controller, coupled to the transmitter and the receiver, for configuring the oscillation circuit to adjust the frequency of the oscillating signal according to at least one of the first data and the values of the first registers, and at least one of the second data and the values of the second registers; wherein the first scrambler and the second scrambler have the same scrambler generator polynomial.

An example embodiment of a communication method, comprising: transmitting to a transmission line a first data scrambled by a first scrambler with a plurality of first registers according to an oscillating signal scrambled by an oscillation circuit; receiving from the transmission line a second data scrambled by a second scrambler; descrambling the second data with a descrambler with a plurality of second registers; and configuring the oscillation circuit to adjust the frequency of the oscillating signal according to at least one of the first data and the values of the first registers, and at least one of the second data and the values of the second registers; wherein the first scrambler and the second scrambler have the same scrambler generator polynomial.

It is to be understood that both the foregoing general description and the following detailed description are example and explanatory only and are not restrictive of the disclosure, as claimed.

DETAILED DESCRIPTION

Reference will now be made in detail to embodiments of the disclosure, which are illustrated in the accompanying drawings. The same reference numbers may be used throughout the drawings to refer to the same or like parts or components/operations. Certain terms are used throughout the description and the claims to refer to particular components. As one skilled in the art will appreciate, a component may be referred by different names. This document does not intend to distinguish between components that differ in name but not in function. In the following description and in the claims, the terms "comprise" are used in an open-ended fashion, and thus should be interpreted to mean "include, but not limited to . . . ." The phrase "coupled with" is intended to compass any indirect or direct connection. Accordingly, if this document mentioned that a first device is coupled with a second device, it means that the first device may be directly or indirectly connected to the second device through electrical connections, wireless communications, optical communications, or other signal connections with/without other intermediate devices or connection means.

Figure 1:
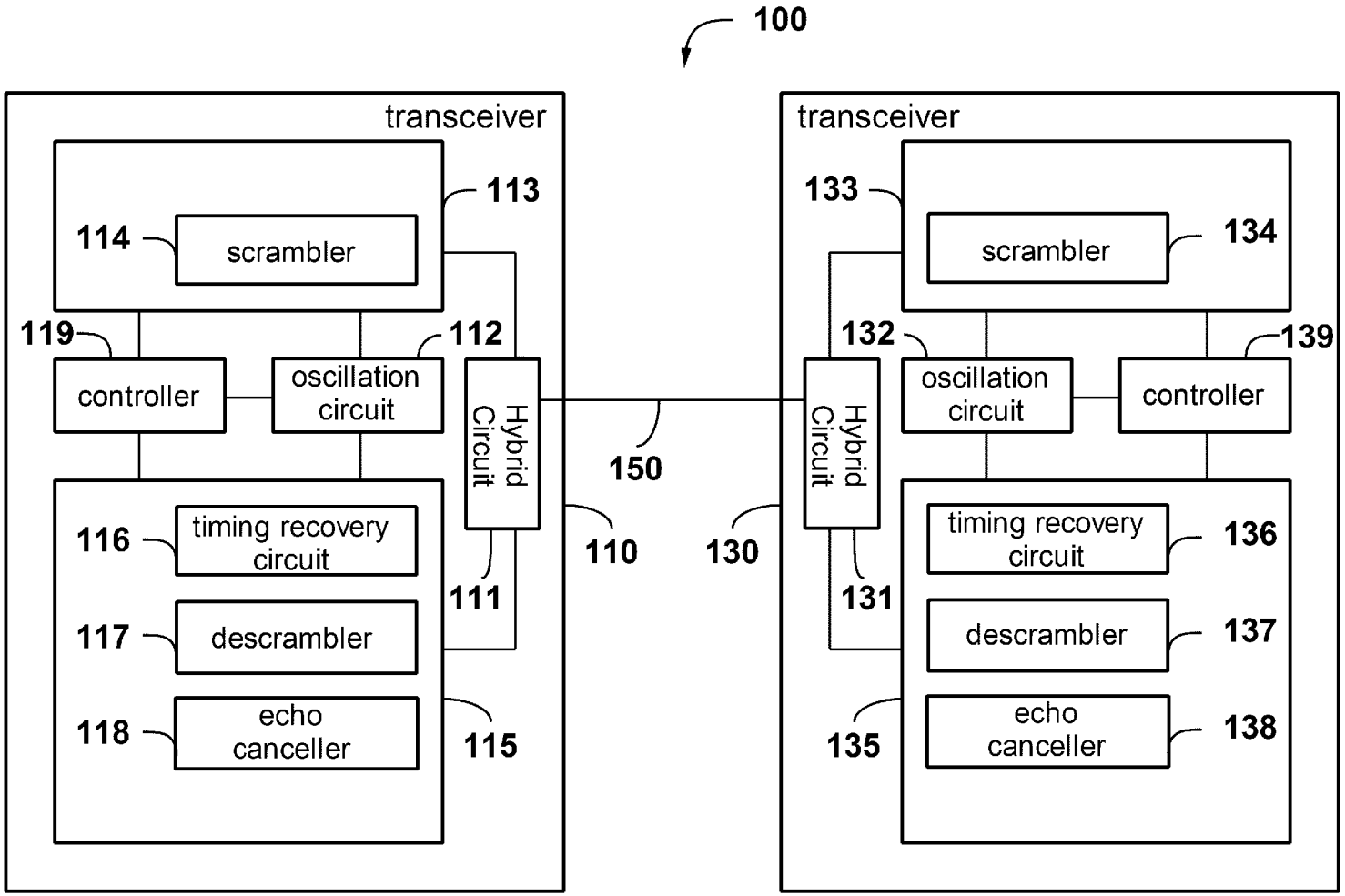
FIG. 1 is a simplified block diagram of an example communication system.

FIG. 1 shows a simplified block diagram of an example communication system 100, arranged in accordance with at least some embodiments of the present disclosure. The communication system 100 comprises a transceiver 110, a transceiver 130, and transmission lines 150. For example, the communication system 100 is an HDMI compatible system. The transceivers 110 and 130 are HEC transceivers of the HDMI transceiving devices and the transmission lines 150 are used for carrying the HEC signals and/or other signals in the HDMI cable.

In this embodiment, the transmission lines 150 are a pair of conductors for carrying differential signals. In another embodiment, the transmission lines 150 are used for carrying single-ended signals. For example, the transmission lines 150 may be realized with Cat-3~Cat-7 twisted pair cables, wirings on the printed circuit board, or other suitable conductors.

The transceiver 110 comprises a hybrid circuit 111, an oscillation circuit 112, a transmitter 113, a receiver 115, and a controller 119. The transmitter 113 comprises a scrambler 114. The receiver 115 comprises a timing recovery circuit 116, a descrambler 117, and an echo canceller 118. The transceiver 130 comprises a hybrid circuit 131, an oscillation circuit 132, a transmitter 133, a receiver 135, and a controller 139. The transmitter 133 comprises a scrambler 134. The receiver 135 comprises a timing recovery circuit 136, a descrambler 137, and an echo canceller 138. Other components, circuits, and connections are omitted in FIG. 1 for conciseness.

In this embodiment, the transmitter 113 of the transceiver 110 transmits signals to the transmission lines 150 through the hybrid circuit 111. The receiver 115 also receives the signals on the transmission lines 150 through the hybrid circuit 111. Because the transmission lines 150 carry the signals from the transmitter 113 of the transceiver 110 and the signals from the transmitter 133 of the transceiver 130, the receiver 115 may remove the signals from the transmitter 113 from the received signals by using the echo canceller 118.

The oscillation circuit 112 is used for generating the oscillating signal with a suitable frequency so that the transmitter 113, the receiver 115, and other components of the transceiver 110 may transmit or receive signals according to the oscillating signal. For example, when the transceivers 110 and 130 are HEC transceivers, the transceivers 110 and 130 shall transmit the signals with the frequency of 125 MHz. When the frequencies of the transceivers 110 and 130 are different, the oscillation circuit 112 and/or the oscillation circuit 132 may be configured to adjust the frequency of the oscillating signal. Thus, the frequencies of the transceivers 110 and 130 may be adjusted to be substantially the same and the transceivers 110 and 130 are synchronized.

The scrambler 114 of the transmitter 110 is used for scrambling the signals before signal transmission. The descrambler 117 is used for descrambling the received scrambled signals and generating the unscrambled signals. The architecture and operation of the scrambler 114 and the descrambler 117 are further described in the following paragraphs accompanied with FIG. 2. Moreover, in this embodiment, the scrambler 114 of the transceiver 110 and the descrambler 134 of the transceiver 130 have the same generator polynomial.

The timing recovery circuit 116 is used for adjusting the timing for transmitting signals and/or receiving signals. For example, the timing recovery circuit 116 may provide the phase compensation and/or the frequency compensation so that the analog-to-digital converter (not shown in FIG. 1) of the receiver 115 may sample the signals at the moderate time. In one embodiment, the receiver 115 receives the signals transmitted by the transceiver 130 from the transmission lines 150. The timing recovery circuit 116 may estimate the frequency of the transceiver 130, i.e., the frequency of the oscillating signal generated by the oscillation circuit 132 of the transceiver 130, according to the signals received by the receiver 115.

The controller 119 is used to configure the transmitter 113, the receiver 114, and/or other components so that the transceiver 110 may transmit and receive signals correctly. For example, in the idle mode or in the connection establishment process, when the transceivers 110 and 130 transmit the same signal, the transceiver 110 and/or the transceiver 130 may not function correctly. Ideally, the input of the descrambler 117 and the output of the scrambler 134 have the same data. To avoid the malfunction of the transceiver 110, the controller 119 may monitor the output of the scrambler 114, the input of the descrambler 117, the registers of the scrambler 114, and/or the registers of the descrambler 117. The controller 119 may therefore detect whether the transceivers 110 and 130 transmit the same signals and configure relevant components correspondingly. The function of the controller 119 is explained with more details in the following paragraphs.

The function and the connection of the components in the transceiver 130 are similar to the counterparts in the transceiver 110, and may be referred to the relevant descriptions above.

Figure 2:
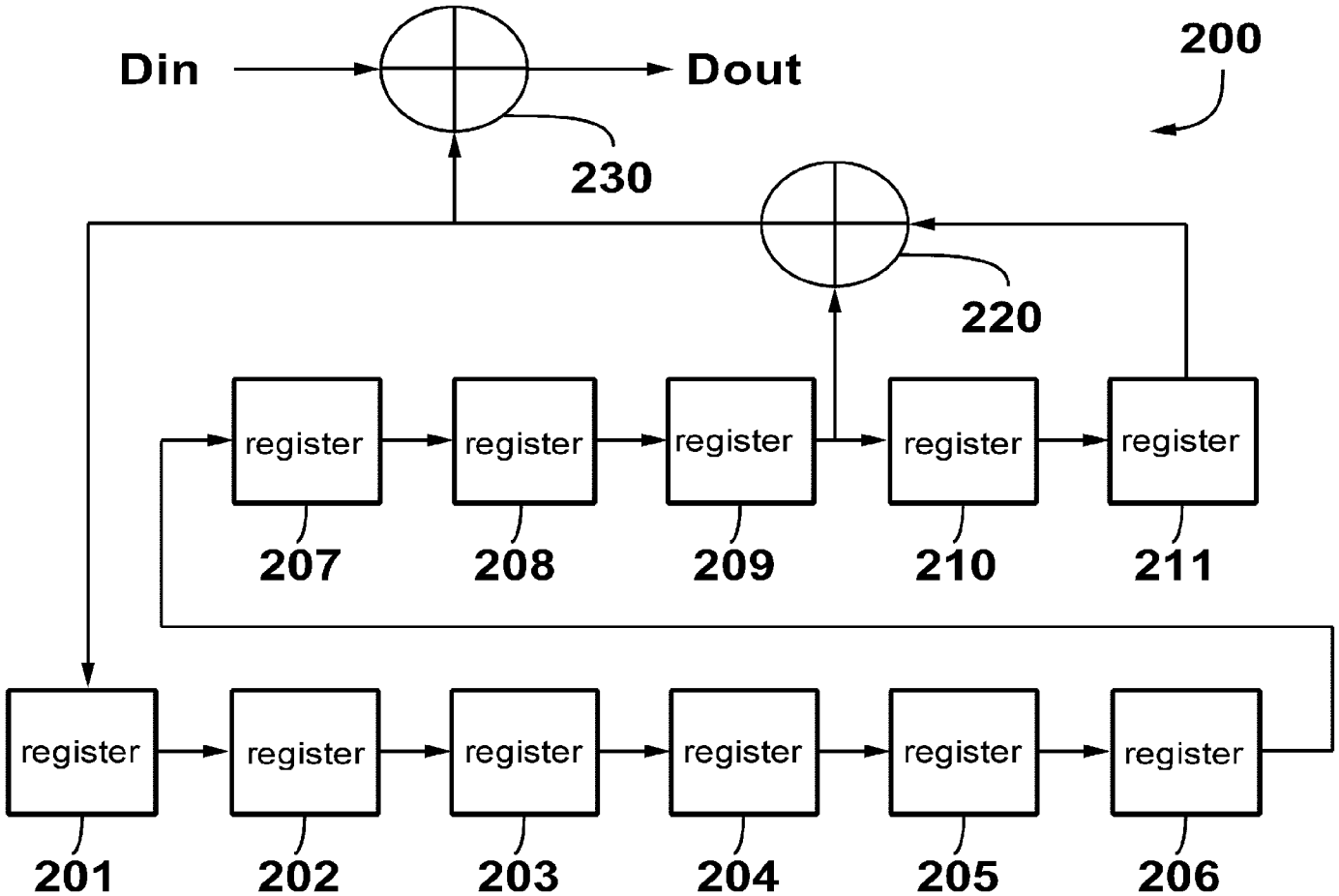
FIG. 2 is a simplified block diagram of an example scrambler/descrambler in FIG. 1.

The operation of the communication system 100 is further explained in the following paragraphs accompanied with FIGS. 1 and 2. FIG. 2 shows a simplified block diagram of an example scrambler/descrambler 200, arranged with reference to at least some embodiments of the present disclosure.

The scrambler/descrambler 200 in FIG. 2 is realized with the scrambler/descrambler architecture of the fast Ethernet 100BASE-TX transceiver. The scrambler/descrambler 200 may be used as a scrambler or a descrambler depending on the input data. When the input data Din are unscrambled data, the scrambler/descrambler 200 functions as a scrambler and outputs scrambled data Dout. When the input data Din are scrambled data, the scrambler/descrambler 200 functions as a descrambler and outputs unscrambled data Dout.

The scrambler/descrambler 200 comprises eleven shift registers 210~211, and two XOR (exclusive or) circuits 220 and 230. The scrambler generator polynomial and the descrambler generator polynomial are both $g(x)=1+x^9+x^{11}$ The operation of the scrambler/descrambler 200 is described as follows. At time T, the input data Din(T) and the values of the shift registers 209 and 211 are processed by the XOR circuits 220 and 230, and output as the output Dout(T) of the scrambler/descrambler 200.

At time T+1, the values stored in the shift registers 201~210 at time T are stored in the shift registers 202~211, respectively. For example, the value stored in shift register 203 at time T is stored in the shift register 204 at time T+1. The values stored in the shift registers 209 and 211 at time T are processed by the XOR circuit 220 and stored in the shift register 201 at time T+1. The input data Din(T+1) and the values of the shift registers 209 and 211 are processed by the XOR circuits 220 and 230 and output as the output Dout(T+1) of the scrambler/descrambler 200.

In this embodiment, the transceiver 110 is configured to transmit idle signals in the idle mode or in the connection establishment process. The transceiver 110 configures the input data Din to be the value "1" and configures the values of the shift registers 201~211 not to be all zeros. The values of the shift registers 201~211 have 2047 possible combinations, i.e., $2^{11}-1$ (except the all zeros situation), which cyclically appear. Accordingly, the output Dout of the scrambler/descrambler 200 has 2047 cyclically appeared values, a.k.a. the idle sequence.

In this embodiment, each of the 2047 cyclically appeared combinations of the values of the shift registers 201~211 is serially assigned to a unique number. For example, according to the operation of the scrambler/descrambler 200, when the values of the shift registers 201~211 are [111111111111], the combination number is assigned as 1. When the values of the shift registers 201~211 are [011111111111], the combination number is assigned as 2. By using this rule, when the values of the shift registers 201~211 are [111111111110], the combination number is assigned as 2047. In another embodiment, another combination of the values of the shift registers 201~211 is assigned as the combination number 1 and the other combinations of the values of the shift registers 201~211 are respectively assigned to unique combination numbers according the operation of the scrambler/descrambler 200 or in other suitable order.

In the specification and the claims, when the combination number of the values of the shift registers 201~211 of the scrambler 114 is N, for the purpose of simplicity, it is referred that the combination number of the scrambler 114 is N. When the combination number of the scrambler 114 is N and the combination number of the descrambler 117 is M, the combination number difference between the scrambler 114 and the descrambler 117 is defined as (N−M).

In other embodiments, the combination number difference between the scrambler 114 and the descrambler 117 may also be defined as (N−M), (N−M) when N>=M and (N−M+2047) when N<M, or (M−N) when M>=N and (M−N+2047) when M<N. In one embodiment, the scramblers 114 and 134 adopt the same definition for the combination number difference to simplify the operation of the controller 119.

In another embodiment, the 2047 possible values are stored in the transceiver 110. The controller 119 compares the values of the shift registers of the scrambler 114 with the values of the 2047 combinations to obtain the combination number of the scrambler 114.

In another embodiment, only parts of the values of the 2047 combinations are stored in the transceiver 110. For example, the transceiver 110 only stores the values [11111111111]. The controller 119 calculates the processing time, the iteration number, the number of input bit(s) of the scrambler 114, and/or the number of output bit(s) of the scrambler 114 before the values of the shift registers of the scrambler 114 become [11111111111]. The controller 119 may directly use or process the calculated data above to obtain the combination number of the scramble 114.

In another embodiment, the 2047-bit cyclically appeared output data of the scrambler 114 corresponding to the combination numbers 1~2047 (i.e., the 2047-bit idle sequence) are stored in the transceiver 110. The controller 119 compares the output of the scrambler 114 with the 2047-bit idle sequence to obtain the combination number of the scrambler 114. For example, after comparing 11 bits output of the scrambler 114 with the 2047-bit idle sequence, the controller 119 finds the 11 bits output matches the $21^{st}$~$31^{st}$ bits of the 2047 idle sequence and determines the combination number of the scrambler 114 to be 31.

In another embodiment, only parts of the 2047-bit cyclically appeared output data of the scrambler 114 corresponding to the combination numbers 1~2047 are stored in the transceiver 110. For example, the transceiver 110 only stores the values [01111111111]. The controller 119 calculates the processing time, the iteration number, the number of input bit(s) of the scrambler 114, and/or the number of output bit(s) of the scrambler 114 before the output of the scrambler 114 become [01111111111]. The controller 119 may directly use or process the calculated data above to obtain the combination number of the scramble 114.

In another embodiment, the transceiver 110 may store the combination number of the scrambler 114 in the storage device. The content of the storage device may be updated accordingly and the calculation of the combination number of the scrambler 114 may be reduced or omitted.

The controller 119 may also adopt the above methods to obtain the combination number of the descrambler 117. The controller 119 may adopt the same or different method(s) to obtain the combination number of the scrambler 114 and the combination number of the descrambler 117.

In another embodiment, the combination number difference is needed. The controller 119 may calculate the processing time, the iteration number, the number of input bit(s) of the scrambler 114, and/or the number of output bit(s) of the scrambler 114 before the values of the shift registers of the scrambler 114 become the values of the shift registers of the descrambler 117. The controller 119 may directly use or process the calculated data above to obtain the combination number difference of the scrambler 114 and the descrambler 117.

In another embodiment, the controller 119 may calculate the processing time, the iteration number, the number of input bit(s) of the scrambler 114, and/or the number of output bit(s) of the scrambler 114 before the output data of the scrambler 114 become the output data of the descrambler 117. The controller 119 may directly use or process the calculated data above to obtain the combination number difference of the scrambler 114 and the descrambler 117.

In the embodiments in FIGS. 1 and 2, the transceivers 110 and 130 and the scrambler/descrambler 200 may be realized with controller(s), processor(s), specifically designed integrated/discrete circuit(s), and/or the collaboration of hardware and software. The components and the connections are illustrative only. Multiple functional blocks may be realized with a single component and a single functional block may be realized with multiple components. The architecture of each functional block may also be modified according to different design considerations. For example, the transceivers may be realized with scramblers, transmitters, and/or receivers of different architectures.

Figure 3:
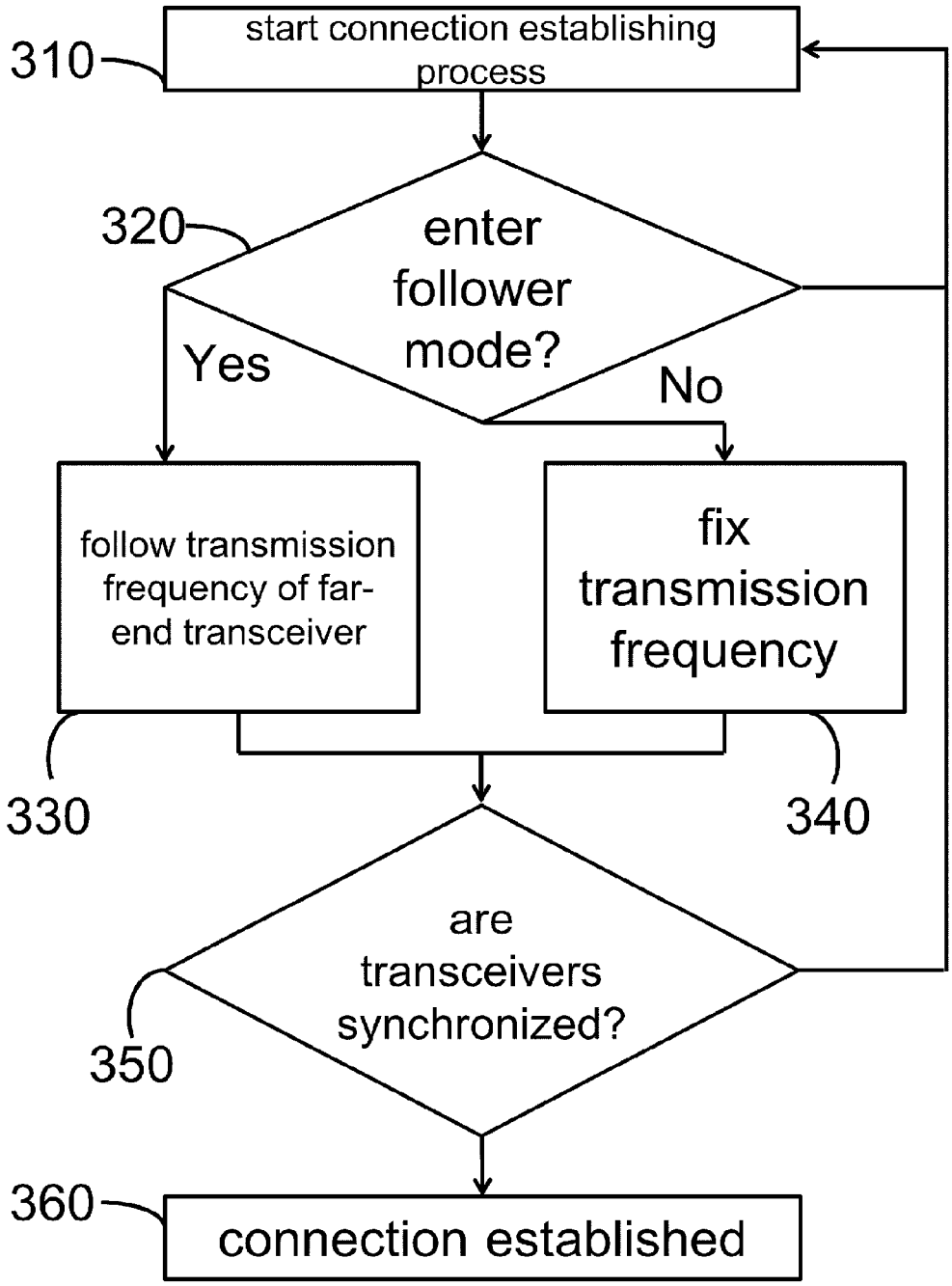
FIG. 3 is a simplified flowchart of an example connection establishing method, all arranged in accordance with at least some embodiments of the present disclosure described herein.

The operation of the communication system 100 is further explained in the following paragraphs accompanied with FIGS. 1-3. FIG. 3 shows a simplified flowchart of an example connection establishing method 300, arranged in accordance with at least some embodiments of the present disclosure.

In the operation 310, the transceivers 110 and 130 start to establish the connection. The transmitters 113 and 133 of the transceivers 110 and 130 both transmit idle signals.

In the operation 320, the controller 119 determines whether the transceiver 110 shall enter the follower mode according to various criterions. For example, the controller 119 may always configure the transceiver 110 as a follower for tracking the transmission frequency of the transceiver 130. If the controller 119 configures the transceiver 110 to enter the follower mode, the method proceeds to the operation 330. Otherwise, the method proceeds to the operation 340. If the controller 119 may not determine whether the transceiver 110 shall enter the follower mode at this moment, the method may go back to the operation 310 to reinitiate the connection establish process. The transceiver 110 and/or the shift registers of the scrambler 114 may be reset when reinitiating the connection establish process.

In the operation 330, the controller 119 determines the transceiver to enter the follower mode. The controller 119 configures the oscillation circuit 112 so that the frequency of the oscillating signal generated by the oscillation circuit 112 may follow the transmission frequency of the transceiver 130, i.e., the frequency of the oscillating signal generated by the oscillation circuit 132. Thus, the transceivers 110 and 130 may transmit and receive signals synchronously (i.e., the transceivers 110 and 130 are synchronized).

In the operation 340, the controller 119 configures the oscillation circuit 112 to generate the oscillating signal of a fixed frequency so that the far-end transceiver 130 may follow the frequency of the oscillating signal generated by the oscillation circuit 112.

In the operation 350, the controller determines whether the transceivers 110 and 130 are synchronized. If the transceivers 110 and 130 are not synchronized, the method goes back to the operation 310 to reinitiate the connection establishing process.

In the operation 360, the connection between the transceivers 110 and 130 are established.

In the description above, the method 300 is explained in the aspect of the transceiver 110. The method 300 may also be applied to the transceiver 130 to establish the connection between the transceivers 110 and 130. The transceivers 110 and 130 may adopt the same or different method(s) to establish the connection. As long as one of the transceivers 110 and 130 adopts the above method(s), the network connection may be established. The method may be applied in the conventional devices without modifying the industry standard and therefore the transceivers 110 or 130 possess very high compatibility.

In one embodiment of the operation 320, the controller 119 determines whether the transceiver 110 shall enter the follower mode according to the output of the scrambler 114, the values of the shift registers of the scrambler 114, the combination number of the scrambler 114, the input of the descrambler 117, the values of the shift registers of the descrambler 117, the combination number of the descrambler 117, and/or the computation result of the data above.

In another embodiment of the operation 320, the controller 119 determines whether the transceiver 110 shall enter the follower mode according to the combination number difference of the scrambler 114 and the descrambler 117. When the combination number difference of the scrambler 114 and the descrambler 117 is greater than a predetermined value (e.g., half of the possible combination numbers of the values of the shift registers of the scrambler 114), controller 119 configures the transceiver 110 to enter the follower mode. For example, when the combination number of the scrambler 114 is 100 and the combination number of the descrambler 117 is 1800, the combination difference, 1700, of the scrambler 114 and the descrambler 117 is greater than a predetermined value 1024. Therefore, the controller 119 may configure the transceiver 110 to enter the follower mode.

In another embodiment of the operation 320, when the combination number difference of the scrambler 114 and the descrambler 117 is less than a predetermined value, controller 119 configures the transceiver 110 to enter the follower mode.

In the idle mode or in the connection establishing process, when the combination number difference of the scrambler 114 and 134 is small, a transmission delay may cause the scramblers 114 and 134 to generate the same output and the transceivers 110 and 130 may fail to function correctly. In another embodiment of the operation 320, when the difference of the combination number difference of the scrambler 114 and the descrambler 117 and a reference value is less than a safety value, the controller 119 may reinitiate the connection establishing process and the method goes back to the operation 310. For example, the reference value and the safety value for the combination number difference of the scrambler 114 and the descrambler 117 are 1024 and 25, respectively. When the combination number difference of the scrambler 114 and the descrambler 117 is 1030, the difference of the combination number difference and the reference value is 6 and less than the safety value 25. Thus, the controller 119 reinitiates the connection establishing process and the method goes back to the operation 310.

In another embodiment of the operation 320, the controller 119 determines whether the transceiver 110 shall enter the follower mode according to the comparison result of the scrambler 114 and the descrambler 117. For example, the controller 119 may determines the transceiver to enter the follower mode when combination number of the scrambler 114 is greater than the combination number of descrambler 117. When the combination number of the scrambler 114 is 1800 and the combination number of the descrambler 117 is 100, the controller 119 may determines the transceiver 110 to enter the follower mode because the combination number of the scrambler 114 is greater than the combination number of the descrambler 117. In another embodiment, the controller 119 may determines the transceiver to enter the follower mode when combination number of the scrambler 114 is less than the combination number of descrambler 117.

In the two embodiments above, when the combination number difference of the scrambler 114 and 134 is too small, a transmission delay may cause the scramblers 114 and 134 to generate the same output and the transceivers 110 and 130 may fail to function correctly. In another embodiment of the operation 320, when the difference of the combination number difference of the scrambler 114 and the descrambler 117 is less than a safety value, the controller 119 may reinitiate the connection establishing process and the method goes back to the operation 310. For example, the combination numbers of the scrambler 114 and the descrambler 117 are 100 and 110, respectively. The difference of the combination number difference and the reference value is 10 and less than the safety value (e.g., 25). Thus, the controller 119 reinitiates the connection establishing process and the method goes back to the operation 310.

In the embodiments above, the controller 119 may determines whether the transceiver 110 shall enter the follower mode according to the output of the scrambler 114, the values of the shift registers of the scrambler 114, the combination number of the scrambler 114, the input of the descrambler 117, the values of the shift registers of the descrambler 117, the combination number of the descrambler 117, and/or the computation result of the data above. It only takes a short time for the determination of the controller 119 in the operation 320. Therefore, the transceivers 110 may rapidly determine the operation mode (enter follower mode or not) after the connection establishing process and the transceivers 110 and 130 may rapidly establish the connection.

In another embodiment, the controller 119 determines the transceiver 110 not to enter the follower mode and the connection of the transceivers 110 and 130 are established. The controller may keep monitoring one or more data to ensure the synchronization of the transceivers 110 and 130. For example, the controller 119 may monitor the combination number difference of the scrambler 114 and the descrambler 117 as the monitoring data. When the variation of the combination difference of the scrambler 114 and the descrambler 117 is too large, it might indicate the transceivers 110 and 130 may not be synchronized. In another embodiment, the controller 119 may also monitor the frequency compensation value of the timing recovery circuit 116 as the monitoring data. When the frequency compensation value is large than a predetermined value, it might indicate the transceivers 110 and 130 may not be synchronized. When the controller 119 detects the transceivers 110 and 130 may not be synchronized according to the monitoring data, the controller 119 may configure the transceiver 110 to enter the follower mode and configure the oscillation circuit 112. Thus, the frequency of the oscillating signal generated by the oscillation circuit 112 may follow the transmission frequency of the transceiver 130, and the transceivers 110 and 130 may transmit and receive signals synchronously.

Although the HEC transceivers are used as embodiments above, the present disclosure may be applicable to the communication systems, in which the transceivers on both ends may transmit the same signals on the same transmission lines at the same time. Therefore, the communication systems may establish connection more rapidly and correctly.

Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A communication device, comprising:

a transmitter, comprising a first scrambler with a plurality of first registers, for transmitting to a transmission line a first data scrambled by the first scrambler according to an oscillating signal generated by an oscillation circuit;

a receiver, for receiving from the transmission line a second data scrambled by a second scrambler, comprising a descrambler with a plurality of second registers for descrambling the second data; and a controller, coupled to the transmitter and the receiver, for configuring the oscillation circuit to adjust the frequency of the oscillating signal according to at least one of the first data and the values of the first registers, and at least one of the second data and the values of the second registers;

wherein the first scrambler and the second scrambler have the same scrambler generator polynomial, the controller compares at least one of the first data and the values of the first registers with at least one of the second data and the values of the second registers for generating a combination number difference, and the controller configures the oscillation circuit to adjust the frequency of the oscillating signal when the combination number difference is not zero.

2. The communication device of claim 1, wherein the controller resets the values of the first registers when the combination number difference is less than a first predetermined value.

3. The communication device of claim 1, wherein the controller compares the values of the first registers and/or the first data with a second predetermined value for generating the first combination number;

the controller compares the values of the second registers and/or the second data with a third predetermined value for generating the second combination number; and the controller configures the oscillation circuit to adjust the frequency of the oscillating signal when the first combination number is not equal to the second combination number.

4. The communication device of claim 3, wherein the controller resets the values of the first registers when the difference of the first combination number and the second combination number is less than a fourth predetermined value.

5. The communication device of claim 3, wherein the second predetermined value equals to third predetermined value.

6. The communication device of claim 1, wherein:

the transmitter further transmits a third data scrambled by the first scrambler to the transmission line;

the receiver further receivers from the transmission line a fourth data scrambled by the second scrambler;

the descrambler descrambles the fourth data;

the controller generates a first monitoring data according to at least one of the first data and the values of the first registers when generating the first data, and at least one of the second data and the values of the second registers when generating the second data;

the controller generates a second monitoring data according to at least one of the third data and the values of the first registers when generating the third data, and at least one of the fourth data and the values of the second registers when generating the fourth data; and the controller configures the oscillation circuit to adjust the frequency of the oscillating signal when the difference of the first monitoring and the second monitoring data is greater than a fifth predetermined value.

7. The communication device of claim 1, further comprising a timing recovery circuit for providing a frequency compensation value, wherein the controller configures the oscillation circuit to adjust the frequency of the oscillating signal when the frequency compensation value is greater than a sixth predetermined value.

8. A communication method, comprising:

transmitting to a transmission line a first data scrambled by a first scrambler with a plurality of first registers according to an oscillating signal scrambled by an oscillation circuit;

receiving from the transmission line a second data scrambled by a second scrambler;

descrambling the second data with a descrambler with a plurality of second registers;

comparing at least one of the first data and the values of the first registers with at least one of the second data and the values of the second registers for generating a combination number difference; and configuring the oscillation circuit to adjust the frequency of the oscillating signal when the combination number difference is not zero;

wherein the first scrambler and the second scrambler have the same scrambler generator polynomial.

9. The communication method of claim 8, further comprising:

resetting the values of the first registers when the combination number difference is less than a first predetermined value.

10. The communication method of claim 8, further comprising:

comparing the values of the first registers and/or the first data with a second predetermined value for generating the first combination number;

comparing the values of the second registers and/or the second data with a third predetermined value for generating the second combination number; and configuring the oscillation circuit to adjust the frequency of the oscillating signal when the first combination number is not equal to the second combination number.

11. The communication method of claim 10, further comprising:

resetting the values of the first registers when the difference of the first combination number and the second combination number is less than a fourth predetermined value.

12. The communication method of claim 10, further comprising:

configuring the second predetermined value to be equal to third predetermined value.

13. The communication method of claim 8, further comprising:

transmitting a third data scrambled by the first scrambler to the transmission line;

receiving from the transmission line a fourth data scrambled by the second scrambler;

descrambling the fourth data with the descrambler;

generating a first monitoring data according to at least one of the first data and the values of the first registers when generating the first data, and at least one of the second data and the values of the second registers when generating the second data;

generating a second monitoring data according to at least one of the third data and the values of the first registers when generating the third data, and at least one of the fourth data and the values of the second registers when generating the fourth data; and configuring the oscillation circuit to adjust the frequency of the oscillating signal when the difference of the first monitoring and the second monitoring data is greater than a fifth predetermined value.

14. The communication method of claim 13, further comprising:

generating a frequency compensation value with a timing recovery circuit; and configuring the oscillation circuit to adjust the frequency of the oscillating signal when the frequency compensation value is greater than a sixth predetermined value.

* * * * *